United States Patent [19]

Wood

[11] 3,982,613

[45] Sept. 28, 1976

[54] RETRACTABLE PULL STRAP ON WHEELED LUGGAGE

[75] Inventor: Robert H. Wood, Dover, Del.

[73] Assignee: Leeds Travelwear, a division of Rapid-American Corporation, Clayton, Del.

[22] Filed: Aug. 7, 1975

[21] Appl. No.: 602,553

[52] U.S. Cl. ..... 190/58 B; 190/18 A; 242/107

[51] Int. Cl.[2] ..... A45C 13/00

[58] Field of Search..... 16/115; 190/18 A, 18 R, 190/57, 58 B; 242/107 R; 280/47.34, 47.37

[56] References Cited

UNITED STATES PATENTS

| | | | |
|---|---|---|---|
| 1,587,427 | 6/1926 | Schwier | 242/107 R |
| 2,732,148 | 1/1956 | Lummis | 242/107 R |
| 3,021,091 | 2/1962 | Swanson | 242/107 R |
| 3,198,300 | 8/1965 | Tuttle | 242/107 R X |
| 3,547,371 | 12/1970 | Gruseck | 242/86.5 A X |
| 3,653,474 | 4/1972 | Sadow | 190/18 A |

*Primary Examiner*—Donald F. Norton

*Attorney, Agent, or Firm*—Ostrolenk, Faber, Gerb & Soffen

[57] ABSTRACT

A retractable pull strap, string, chain or cord for wheeled luggage wherein a casing with a spring wound spool is mounted in the luggage adjacent an opening through which the strap, string, chain or cord may be drawn. The handle may be ornamental, have the logo of the manufacturer, carry an identification tag or be removable or replaceable.

7 Claims, 9 Drawing Figures

FIG. 1
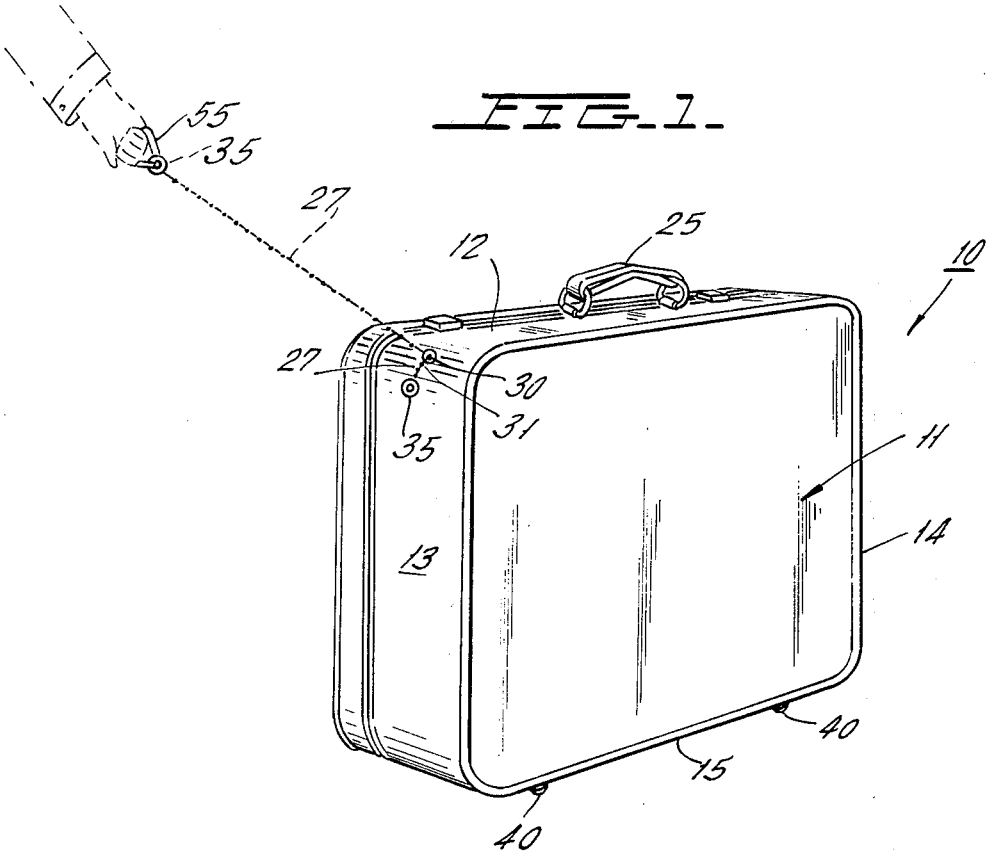
FIG. 3
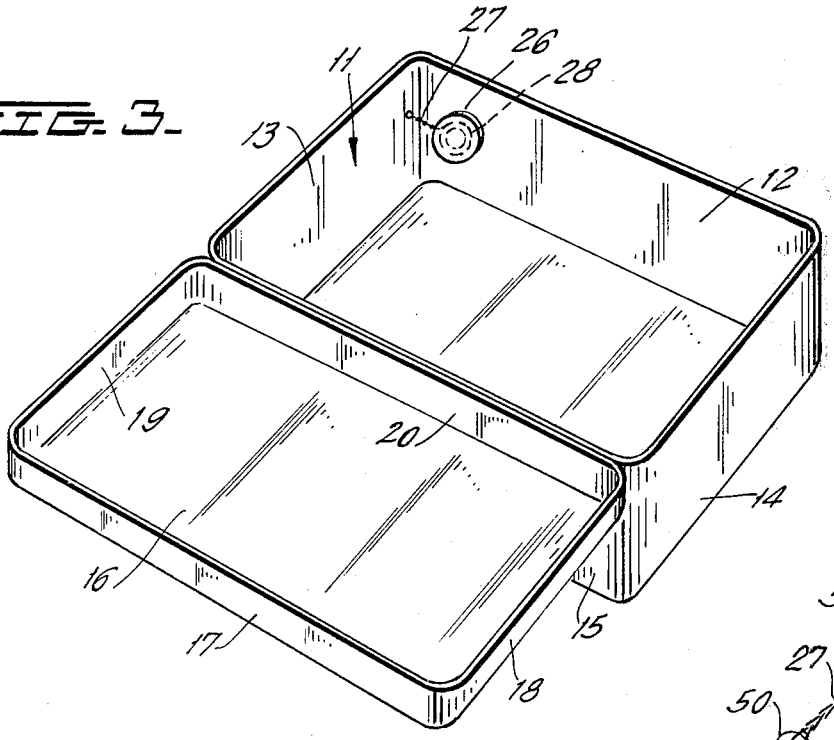
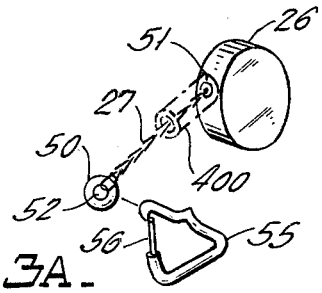
FIG. 3A

FIG. 2
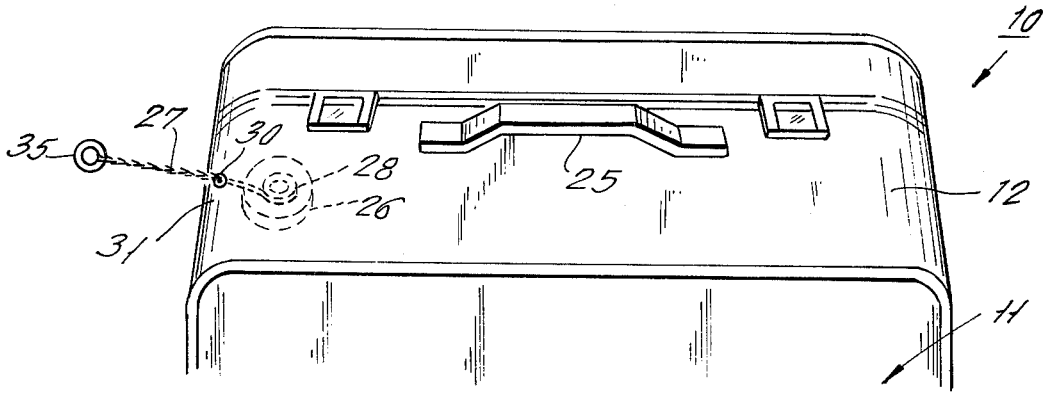
FIG. 4
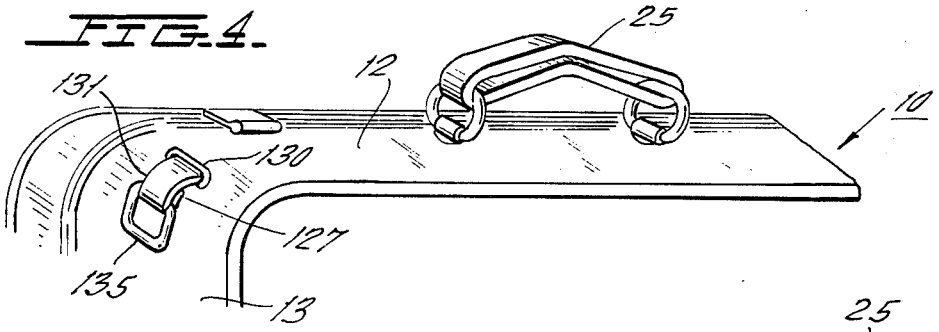
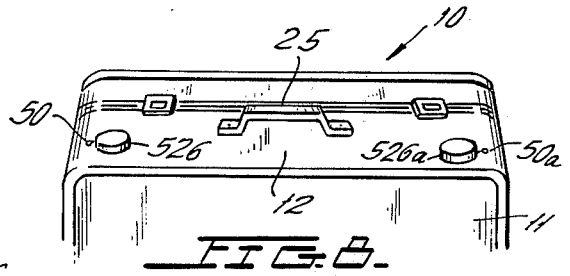
FIG. 8
FIG. 5
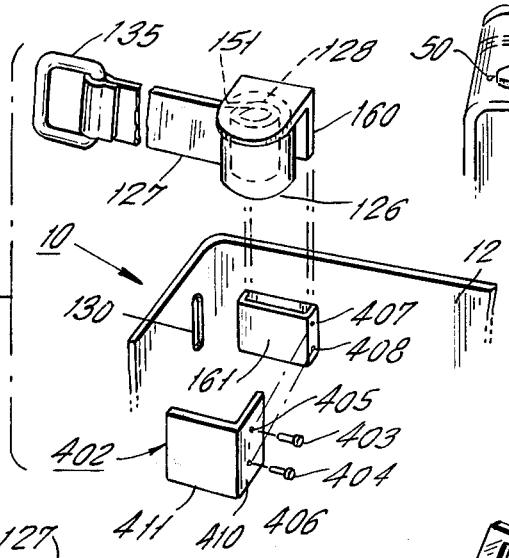
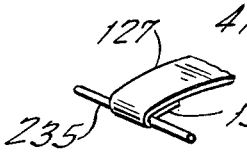
FIG. 6
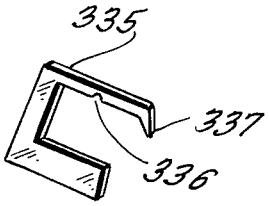
FIG. 7

RETRACTABLE PULL STRAP ON WHEELED LUGGAGE

BACKGROUND OF THE INVENTION

The present invention relates to luggage, including suitcases and other structures hereinafter described and, more particularly, to luggage equipped with integral rolling means so that the same may be drawn along where desired instead of being carried.

This invention is, in part, based on the disclosure set forth in Application Ser. No. 495,647, filed Aug. 8, 1974, for luggage with pull device (now U.S. Pat. No. 3,924,872) assigned to the assignee of the present invention.

Various types of pull strap arrangements have been provided, usually without regard to the final appearance of the luggage itself. Such strap arrangements have been either removably attached or permanently attached, and have invariably been external to the luggage. In the afore-mentioned application (U.S. Pat. No. 3,924,872), an attempt was made to provide an ornamental appearance for the exterior of the luggage when the pull strap was not in use by storing the pull strap in a manner which would maintain the balance of the appearance and design of the luggage.

BRIEF DESCRIPTION OF THE INVENTION

This invention has for its primary object the provision of a retractable pull cord, string, chain or strap for pulling along luggage which is provided with wheels or other rolling mechanism. The retractable pull cord, string, chain or strap is preferably encased within the luggage and the cord, string, chain or strap is accessible through an appropriate protected opening on the outside of the luggage. The end of the pull cord, string, chain or strap may be provided with a grip for pulling the same, which may in addition be ornamental containing the logo of the manufacturer or some other ornamental device which will enhance the appearance of the luggage, or it may contain an identification tag. The retraction of the pull cord, string, chain or strap will remove the same from the exterior of the luggage, leaving only the ornamental handle or grip.

The foregoing and other objects of the present invention will become apparent in the following description and drawings in which:

FIG. 1 is a view in perspective of a novel piece of rolling luggage made in accordance with the present invention showing the pull chain fully retracted.

FIG. 2 is a phantom view in perspective of the upper section of the luggage of FIG. 1 showing the location of the pull chain structure in the luggage of FIG. 1.

FIG. 3 is a view in perspective of the interior of the luggage of FIGS. 1 and 2 showing the pull chain structure in position at the top surface of the main body of the luggage.

FIG. 3A is a view of a modified form of handle or grip for the pull chain of FIGS. 1–3.

FIG. 4 is a view corresponding to that of FIG. 1 showing the utilization of a pull strap rather than a pull chain.

FIG. 5 is an expanded view showing the arrangement of the pull strap in the luggage of FIG. 4.

FIG. 6 shows one type of handle or pull bar for utilization with the strap, preferably of FIGS. 4 and 5, although it may be used with the pull chain of FIGS. 1 and 2.

FIG. 7 is a view of another type of pull handle which may be used with the pull chain of FIG. 1, or the pull strap of FIG. 3.

FIG. 8 is a view of the exterior of a piece of luggage having an alternate form of external retractable pull chain.

As previously pointed out, one of the major problems which arises in connection with pull straps which are utilized for luggage is that the pull strap must either be stored and carried separately from the luggage and installed when it is desired to be used, or the pull strap must be stored on the exterior of the luggage in such a manner that it may be out of the way when the luggage is carried but nevertheless available for use.

This invention is directed to an arrangement whereby the pull strap, chain, cord or string is completely retracted within the luggage and is available for use simply by pulling on the handle thereof which is exterior of the luggage.

In FIGS. 1, 2 and 3, there is shown an article of luggage 10 having a main body 11 consisting of a top wall 12, side walls 13, 14 and a bottom wall 15. The luggage lid 16 comprises a main body having top wall 17, side walls 18 and 19 and a bottom wall 20. A handle 25 is provided preferably at the top wall 12 of the main container section the luggage body 11, although various types of handle arrangements may be used including a handle on each of the walls 12 and 17 which may be griped together if desired.

The interior of the top wall 12 adjacent to the wall 11 is provided with a casing 26 in which is mounted a retractable pull chain 27 — the pull chain being retractable in any suitable manner as, for instance, by a spring, not shown, which winds up the spool 28 within the casing 26 on which the retractable pull chain 27 is mounted. The retractable pull chain 27 is drawn through the reinforced opening 30 of the section 11 of the suitcase, preferably at the area 31 between walls 12 and 13.

In the usual suitcase arrangement, the segment 31 of the main body of the suitcase 11 between the walls 12 and 13 is a curved segment. Whether it is curved or not, the opening 30 may, if desired, be in the wall 12 or in the wall 13, or at the curved segment 31 between the walls. The casing 26 of the pull chain 27 is so positioned in the top section 12 of the main portion 11 of the suitcase that when the chain 30 is fully withdrawn, it extends straight on a line with the spool 28 so that no bias or twist is applied to the chain 30. The exterior of the chain 30 may be prevented from being fully withdrawn into the casing 26 and hence into the inside of the suitcase by the ornamental handle 35.

The bottom wall 15 of main case 11 is provided with wheels 40, and thus when the pull chain 27 is pulled out through the opening 30 by means of the handle 35 and the luggage is drawn along the manual grip on the handle 35, it will be free to roll.

If it is desired to have the pull chain 27 fully retracted, it may be so arranged as shown in FIG. 3A, that a link or bead 50 may be provided which is too large to enter the opening 30 in the suitcase. The enlarged link or bead 50 may be provided with an opening 52 through which a handle 55 may be inserted. When the handle 55 is thus withdrawn from the link or bead 50, the link or bead 50 is of sufficient size to pass through the reinforced opening 30 but not into the opening 51 of the casing and is thus available for use.

When it is desired however to utilize the pull chain or strap as, for instance, when the luggage is packed very heavily, then the pull chain 27 is pulled out of the casing 28 and the bead 50 is passed through the opening 30 to the exterior of the luggage and the handle 55 is snapped on. The link or bead 50 may, in the alternative, be made too large to pass through opening 30 of the luggage and thus be available at all times at the exterior of the luggage.

A spring retainer 56 may be provided on the handle to prevent the handle from being removed unintentionally from the opening 52 of the bead or chain link 50, but to permit it to be put on readily. The handle 55 may be stored on the interior of the luggage by being passed through the opening 52 of the bead or link 50 after it is retracted.

Where the handle 55 is ornamental or fits in with the other hardware on the suitcase, or is intended to serve in addition as an identification tag, the arrangement may be such that the handle or pull member 55 will be permanently and not removably attached to the pull chain or string.

In FIGS. 1, 2, 3 and 3A, the arrangement has been shown in which a pull chain, string, or cord is used as well as any other device which may readily be coiled up without regard to its particular transverse dimension.

It will be obvious, however, as shown in FIGS. 4 and 5 that a pull strap may be used. The pull strap 127 emerges from the luggage through the reinforced opening 130 and is provided with the ornamental handle 135. A casing 126 having a take-up spool 128 which is spring driven to wind up the strap 127 is mounted inside the luggage. The take-up spool 128 may either be permanently or removably mounted at the top wall 12 of the casing section 11 of the luggage 10, and then operate in the manner previously described.

If desired, and particularly where the handle 135 is removably in any suitable manner or in the manner described in connection with FIGS. 1 to 3 by being removable or replaceable in the strap loop 131, the casing 126 may be provided with a retainer 160 consisting of a flange like member which will be insertable in the socket 161 on the wall 12 of the luggage 10.

The strap casing 126 may occupy space which will not be needed if the material packed in the luggage is very light. Where, however, the luggage is to be packed so that it is quite heavy, then the member 160 may be inserted in the receptacle 161 and the strap 127 led out through the slot 130 and the handle 135 may be attached. Here, the casing 126 for the spool 128 of the strap 127 may be provided with the opening 151 which is so sized that the handle receiving loop 131 cannot enter therein.

The ornamental grip 135 may then be readily removed and attached in the manner described in connection with FIGS. 1 to 3A, and the actual pull unit 128 may be detached if desired, and left in the bottom of the container or even kept separated therefrom.

Preferably, however, since the member 128 will be at the top of the luggage when the luggage is in use, it will be out of the way of the contents of the luggage and thus the member 160 may be permanently attached to the member 161. Likewise, the pull grip 135 may be permanently attached to the strap 127, particularly when the pull member 135 is ornamental or carries a particular logo or provides for identification or in any other way that makes it desirable from the point of view of appearance and use for the handle 135 to be external to the strap.

FIG. 6 shows a modified embodiment of the handles of 135 or 35 of FIG. 4 or FIG. 1 where the handle 235 may be drawn through the loop 131 of the strap 127 of FIG. 4, or may constitute a bar drawn through the bead 50 of the pull chain 27 of the structure shown in FIGS. 1 to 3A.

In FIG. 7 is shown another modified form of handle 335 for either the strap or the chain. Where the chain is used, the opening 52 in the bead or loop will be caught in the notch 336. Where a strap is used, the handle may be offset in such a manner and provided with a retainer 337 so that the loop 131 of the strap 127 may be retained thereby.

Normally the location of the pull strap or chain is such that when in use the pull strap or chain is at the top and the contents of the luggage have settled as far as they can toward the bottom wall which has the wheels. However, since it is possible that a piece of luggage may be packed very tightly it may under certain circumstances be desirable to provide protection for the contents of the luggage from any possible abrasion by the pull chain or strap. Accordingly as shown in FIG. 3A a tubular member 400 may be added to the casing 26 of the pull chain extending from the opening 51 in the casing to the opening 30 in the luggage thereby providing complete protection for any clothing. This construction may of course be used in the pull chain of FIGS. 1, 2 and 3.

Similarly in the case of the pull strap shown in FIGS. 4 and 5 a rectangular tubular member may be used but it will be simpler to provide a protective flange 402 secured by appropriate rivets 403, 404 through openings 405, 406 to the retainer 161 for the strap carrying member 160, the said rivets passing through the openings 407, 408. The flange member 402 may be an L-shaped member having one leg 410 secured to the retainer 161 as above set forth and the other section 411 extending to the wall 13 of the luggage thereby providing a shield for the strap 127 and hence protection for the luggage.

In a modified form shown in FIG. 8 the retractable pull chain or strap may be mounted on the exterior of the luggage in such manner as to enhance the external appearance thereof. Thus in FIG. 8 a casing 526 is shown for the pull chain, the end 50 of which is shown accessible from the exterior thereof and a corresponding member **526*a* is shown having a member 50*a* extending therefrom. The member 526 may have the construction of the pull chain casing 26 of FIGS. 1, 2 and 3. The member 526*a* may be a dummy; the extension 50*a* thereof may be provided with an identification tag. While the construction as therein shown in FIG. 8 entails additional hardware and the use of a dummy to balance the appearance of the actual pull chain, the dummy of course is not essential. The pull chain container 526 is here shown remote from the other hardware of the luggage. It will be obvious that the pull chain housing 526** may be incorporated with another portion of the hardware of the luggage such as one of the handle supports or even an extension of one of the lock elements.

While in the foregoing reference has been made to the use of a pull chain or strap the preferred pull member will be a braided or monofilament nylon cord or other plastic material having an acceptable appearance and having low friction or abrasion with the casing or any clothing in the luggage.

Thus, as above pointed out, a pull chain, string or cord may be used in the form of an actual catenated chain or an actual string which can be of wire, cable, leather, or any other suitable material which may be rolled up on the retractable spool 28 within the casing 26 of FIGS. 1 to 3A. Similarly, a retractable strap which is basically a flat member having some substantial width may be utilized which may be rolled or retracted in the manner shown in FIGS. 4 and 5. The spring which is not shown in either of the retractable casings of FIG. 1 or FIG. 4 is a well known wind-up coil spring with one end connected to the spool axle and the other to the casing, for the purpose of withdrawing the entire unit to the position shown in FIGS. 1 and 4, and its only function and the only load to which the spring is subjected is the retraction load. When the spring, cord, chain or strap are pulled out, they are pulled out to their utmost limit in order to exert the necessary pulling force on the luggage and, thus, the wind-up spring itself is under no additional load at that time; it is simply biased to return the spool when the pull is released.

It will now be obvious that the luggage except for the wheels which may be ornamental and well concealed on the bottom wall of the luggage will look like any other luggage except that at one of the upper corners or areas of the luggage there will be an ornamental member which will serve as a handle but may serve other functions as above described.

In the foregoing, the present invention has been described solely in connection with the preferred embodiments thereof. Since many variations and modifications of this invention will now be obvious to those skilled in the art, it is preferred to be bound not by the specific disclosures herein contained but only by the appended claims.

The embodiments of the invention in which a specific privilege or property is claimed are defined as follows:

1. In luggage having top, bottom side and end walls, a flexible elongated pull member for luggage, a support for said flexible elongated pull member, a spool carried by said support;

one end of said flexible elongated pull member being attached to said spool;

said support being secured within said luggage at a portion of said luggage remote from said bottom wall;

an opening in said luggage adjacent said support;

said flexible elongated pull member extending through said opening to the exterior of said luggage;

said spool being biased to retract and wind up said flexible elongated pull member;

said flexible elongated pull member being extendable through sid luggage opening to pull the luggage and being retractable by said spool when released;

said support comprising a casing; said casing having an opening through which said flexible elongated pull member is drawn; said casing opening and said luggage opening being aligned;

said casing being mounted on the interior of the top wall of the luggage and the said opening in the luggage is at an area thereof adjacent a junction between the said top wall and an end wall.

2. The luggage and flexible elongated pull member of claim 1, wherein said flexible elongated pull member is a strap and the openings in the luggage and casing are slots accommodating the strap.

3. The luggage and flexible elongated pull member of claim 1, wherein said flexible elongated pull member is a chain.

4. The luggage and flexible elongated pull member of claim 1, wherein said flexible elongated pull member is a cord.

5. The luggage and flexible elongated pull member of claim 1, wherein the end of the flexible elongated pull member extending from the opening in the luggage comprises a handle dimensional to block full retraction of said flexible elongated pull member through said luggage opening.

6. The luggage and flexible elongated pull member of claim 5, wherein said handle is ornamental.

7. The luggage and flexible elongated pull member of claim 5, wherein said handle is removable and replaceable at the free end of said flexible elongated pull member.

* * * * *